United States Patent [19]

Bachot et al.

[11] Patent Number: 4,749,462

[45] Date of Patent: Jun. 7, 1988

[54] ELECTROLYTIC OXIDATION/APPARATUS

[75] Inventors: Jean Bachot, Fontenay-aux-Roses; Jean-Yves Dumousseau, Paris, both of France

[73] Assignee: Rhone-Poulenc Specialites Chimiques, Courbevoie, France

[21] Appl. No.: 3,370

[22] Filed: Mar. 25, 1987

Related U.S. Application Data

[62] Division of Ser. No. 775,771, Sep. 13, 1985, Pat. No. 4,657,644.

[30] Foreign Application Priority Data

Sep. 13, 1984 [FR] France ..... 84 13641

[51] Int. Cl.[4] ..... C25B 15/08; C25B 9/00

[52] U.S. Cl. ..... 204/237; 204/257; 204/263

[58] Field of Search ..... 204/237, 252–258, 204/263–266

[56] References Cited

U.S. PATENT DOCUMENTS

| | | | |
|---|---|---|---|
| 3,660,259 | 5/1972 | Danly et al. | 204/237 X |
| 4,292,160 | 9/1981 | Marcantino | 204/237 |
| 4,545,877 | 10/1985 | Hillis | 204/237 X |
| 4,648,953 | 3/1987 | Wardle et al. | 204/257 X |

*Primary Examiner*—Donald R. Valentine

*Attorney, Agent, or Firm*—Burns, Doane, Swecker & Mathis

[57] ABSTRACT

Process/apparatus for electrolytically oxidizing solutions of ionic compounds features the electrolytic oxidation of such solutions in a first anode compartment of an electrolytic cell, said electrolytic cell further comprising a second anode compartment, a cathode compartment, and a pair of cationic membranes respectively separating said cathode compartment from said first and second anode compartments; transferring a portion of said solution electrolytically oxidized in said first anode compartment to said second anode compartment and there continuing the electrolytic oxidation thereof; and then recovering product of electrolytic oxidation from said second anode compartment.

6 Claims, 2 Drawing Sheets

25
18
8
11
20
3
19
6
4
5
2
7
17
1
10
16
13
14
22
15
31
33
34
36
32
30
35

ELECTROLYTIC OXIDATION/APPARATUS

This application is a division, of application Ser. No. 775,771, filed Sept. 13, 1985, now U.S. Pat. No. 4,657,649.

BACKGROUND OF THE INVENTION

1. Field of the Invention:

The present invention relates to a process for electrolytically oxidizing saline solutions, notably solutions of cerium salts, and to an electrolytic apparatus well suited for carrying out such electrolytic process.

2. Description of the Prior Art:

Various processes and apparatus for electrolytic oxidation are well known to this art. In the known apparatus, however, the current densities obtained are typically low and the faradic yields weak. Thus, serious need exists in this art for electrolytic oxidation process-/apparatus devoid of such disadvantages and drawbacks.

SUMMARY OF THE INVENTION

Accordingly, a major object of the present invention is the provision of improved electrolytic process/simple apparatus for the electrolytic oxidation of a variety of solutions.

Briefly, the present invention features the electrolytic oxidation of chemical compounds in solution, whereby the solution is treated in a first anode compartment of an electrolytic cell, comprising a first anode compartment and a cathode compartment separated by a first cationic membrane. The solution from the first anode compartment is then treated in a second anode compartment of the electrolytic cell, separated from the cathode compartment by a second cationic membrane. The solution exiting the second anode compartment is recovered and defines the product of the process. An electrolyte is circulated in said cathode compartment, and a fraction of the electrolyte from that compartment may be combined with the solution entering the first anode compartment, while the remainder may be recycled to said cathode compartment.

DETAILED DESCRIPTION OF THE INVENTION

Figure 1:
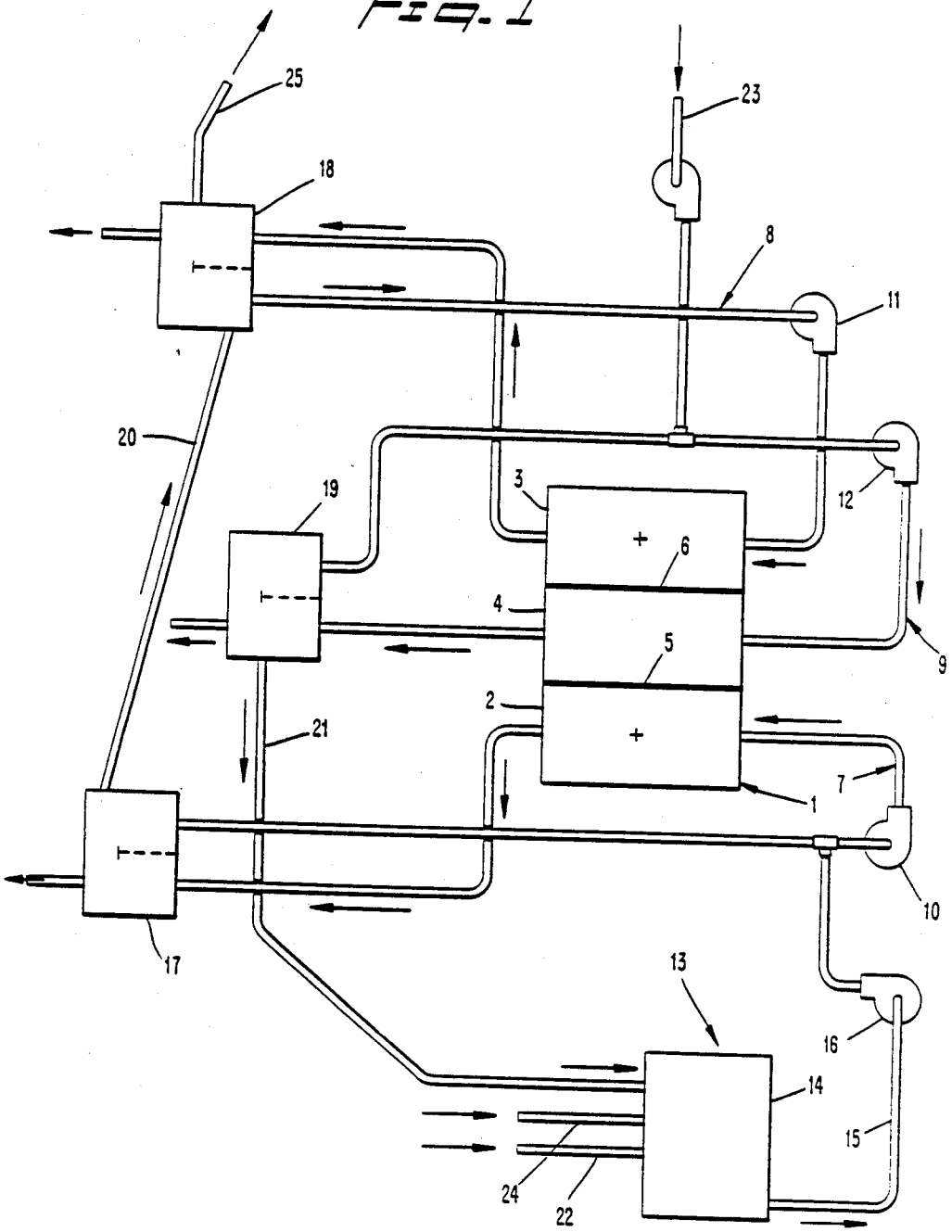

More particularly according to the present invention, in a first embodiment thereof, the electrolytic oxidation of a chemical compound in solution is characterized in that, in a first loop circuit, said solution is treated in the first anode compartment of an electrolytic cell comprising a first anode compartment and a cathode compartment, separated by a first cationic membrane, and a first portion of the solution treated is recycled to said anode compartment. In a second loop circuit, the second, remaining portion of the solution is treated in a second anode compartment of said electrolytic cell, separated from the cathode compartment by a second cationic membrane, and a portion of the solution thus treated is recycled to the second anode compartment, while the remainder of the solution is separated and recovered as the product of the process. An electrolyte is circulated in the cathode compartment, and a portion of the electrolyte exiting that compartment is combined with the solution circulating in the first cycle, while the remainder is recycled to said cathode compartment.

It is further advantageous to employ different anodic current densities in the first and second anode compartments, that in the first being higher.

The invention also features an electrolytic unit for carrying out the aforementioned process. It is characterized in that it comprises:

(i) Two anode compartments (2,3);

(ii) A cathode compartment (4) located between said two anode compartments;

(iii) Two cationic membranes (5,6) separating each of the anode compartments from the cathode compartment;

(iv) A first loop for the circulation of anolyte supplying the first anode compartment;

(v) Means for introducing anolyte into the first loop;

(vi) A second loop for the circulation of anolyte supplying the second anode compartment;

(vii) A first bypass connecting said first and second loops;

(viii) A third loop for the circulation of catholyte supplying the cathode compartment; and (ix) A second bypass connecting said third loop to the means for introducing anolyte into the first loop.

Figure 2:
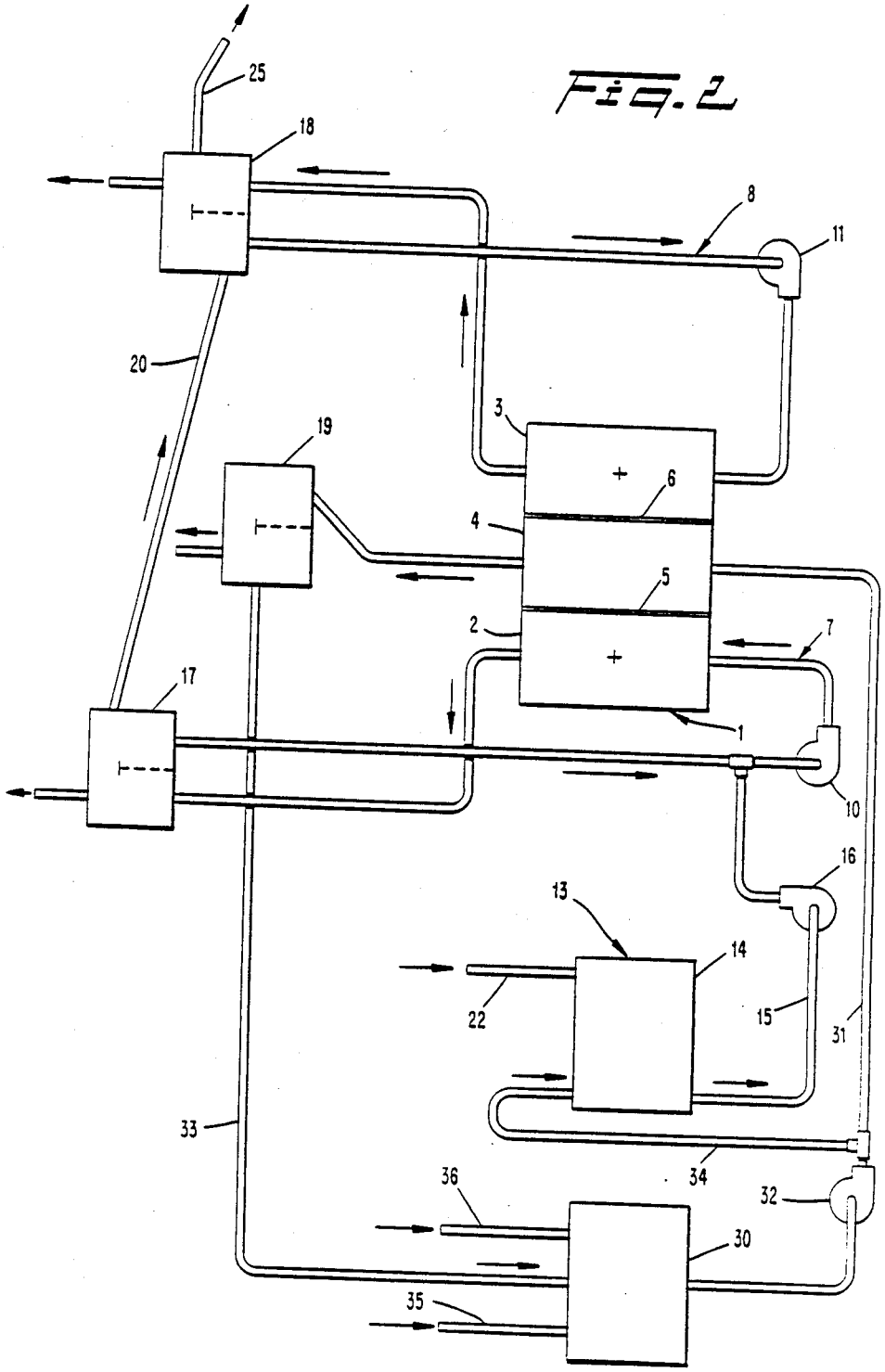

Other features and advantages of the invention will be more apparent from the following description, which refers to the accompanying Figures of Drawing. In the drawings:

FIG. 1 is a diagrammatic representation of an electrolytic unit according to a first embodiment of the invention; and FIG. 2 is a diagrammatic representation of an electrolytic unit according to a second embodiment.

FIG. 1 depicts an electrolytic cell 1 comprised of three compartments. Compartments 2 and 3 are anode compartments and cathode compartment 4 is disposed between them. The respective compartments are separated from one another by two cationic membranes 5 and 6.

Generally, any suitable type of electrode may be used, for example, electrodes in expanded and/or rolled form with a titanium substrate coated with platinum, iridium or alloys of precious metals in the case of the anodes; the cathodes may be made of platinum covered titanium, or may comprise a titanium substrate coated with palladium.

The anode compartments may also be equipped with turbulence promoters located between the membrane and the anode. The compartments 2, 3 and 4 of the cell each have loops or circuits 7, 8 and 9, respectively, for the circulation of electrolyte fitted onto same, the loops being provided with the respective pumps 10, 11 and 12.

The circuit 7 is supplied with anolyte by a feed unit 13. In the example illustrated, this comprises a tank 14 receiving the solution to be treated, a pipe conduit 15 connected to the circuit 7 and a supply pump 16.

All three circuits 7, 8 and 9 are equipped with the respective tanks 17, 18 and 19 which are discharged through an overflow, the tanks acting chiefly as splash heads.

A bypass pipe 20 connects the circuits 7 and 8 via the tanks 17 and 18.

The loop circuit 9 is connected to the feed unit 13 for the loop circuit 7 via bypass pipe conduit 21. In the embodiment illustrated, the pipe 21 discharges into the tank 14.

The electrolytic unit is externally supplied with solution to be treated through a pipe conduit 22, and with catholyte through the pipe conduit 23 connected to the loop circuit 9. A pipe 24 allows for any readjustment of the concentration of the solution to be treated. In the case of a nitric solution of cerium, for example, the necessary amount of nitric acid may be added through said line 24. Finally, the outlet pipe 25 enables the treated solution to be discharged externally.

The operation of the unit is readily apparent from the above description. It will nonetheless be described briefly below, using a nitric solution of $Ce^{3+}$ as an example.

The solution to be treated, containing the $Ce^{3+}$ to be oxidized, is placed into the tank 14 and is then circulated within the loop circuit 7. In the anode compartment the $Ce^{3+}$ is oxidized according to the reaction scheme:

$$Ce^{3+} \rightarrow Ce^{4+} + e^-$$

There is a transfer of $H^+$ cations and cerium cations through the membranes 5 and 6.

The solution exiting the compartment 2, containing a higher concentration of $Ce^{4+}$, is partially recycled to the loop circuit 7 and partially discharged through the overflow of the tank 17 and conveyed through the bypass 20 to the circuit 8.

In the loop circuit 8 the solution is subjected to a second electrolytic treatment by charging same into the compartment 3. It is further enriched with $Ce^{4+}$ and partially recycled and partially discharged, just as was the solution in the loop circuit 7. The flowstream transported via the pipe conduit 25 defines the product of the process of the invention.

The catholyte, comprising a nitric acid solution, circulates within the loop circuit 9. The content in nitric acid is readjusted by means of pipe 23. A portion of the catholyte is discharged through the overflow of the tank 19 and returned through the pipe 21 to the tank 14. This feature of the system thus enables the cerium ions which have passed into the catholyte compartment to be returned to the solution to be treated.

FIG. 2 depicts a second embodiment of the electrolytic unit of the invention, which differs from that illustrated in FIG. 1 essentially in respect of the loop in which the catholyte circulates. The same references have therefore been used for components of the FIG. 2 unit which are identical to those of FIG. 1, and these components will not again be described.

The loop for circulating the catholyte comprises a reservoir 30, which is connected to the cathode compartment by a pipe conduit 31 fitted with pump 32. The loop is completed by the pipe conduit 33 connecting the tank 19 to the reservoir 30.

A bypass 34 connects the catholyte loop to the tank 14. Finally, pipes 35 and 36 respectively supply the tank 30 with water and catholyte, for example, nitric acid.

Operation is identical to that in the FIG. 1 embodiment.

The FIG. 2 embodiment permits improved control of concentrations, since the anolyte supply tank 14 is in this case separate from the reservoir 30 for the cathodic solution. Under these new conditions:

(a) The supply tank 14, which is adjusted at the outset, is at a quite specific concentration of $Ce^{3+}$ throughout the operation; this stability facilitates control of the operation of the cell and thus the process of obtaining an optimum $Ce^{4+}/Ce^{3+}$ conversion rate;

(b) At the same time, the $HNO_3$-$Ce^{3+}$ cathodic mix is stored in the reservoir 30 and does not upset the concentration in the supply tank 14.

When continuous operation is desired, it is possible to reconstitute the supply solution in the tank 14 virtually instantaneously by mixing known quantities of the solution to be treated (pipe 22) and of the cathodic solution held in storage, adjusted with $HNO_3$ and $H_2O$ (pipes 35 and 36).

More generally, the method and apparatus of the invention may be used for electrolytic oxidation of any chemical compound. They may, for example, be applied to thallium (oxidation of thallium I to thallium III) or cerium (cerium III oxidized to cerium IV).

A particularly advantageous application is in the preparation of red solutions of cerium IV.

These red solutions are presently prepared by a two-stage process. The first stage begins with Ce III, and a cerium IV hydroxide is precipitated by means of an oxidizing agent, with adjustment of the PH. At a second stage, the hydroxide is redissolved in hot concentrated nitric acid, to give a red solution of cerium IV.

The electrolytic method of the invention makes it possible to pass directly from the cerous nitrate solution to the red solution and to economize in reagents, particularly nitric acid, a large excess of which has to be used to redissolve the ceric hydrate. The method of the invention also increases productivity and safety.

For this application the procedure described above is followed, namely, with a feed solution 22 in the form of a cerous nitrate solution; the solution may contain nitric acid.

Another example of the invention can be found in the preparation of ceriammoniacal nitrate ($Ce(NO_3)_4$, 2 $NH_4NO_3$).

It is known that a product of this type can be prepared from red solutions by adding ammonium nitrate thereto and carrying out precipitation hot.

The method of the invention enables the product to be prepared directly from a solution of cerium III nitrate and ammonium nitrate.

In this case, the method and apparatus of the invention feature using a solution of cerous nitrate and ammonium nitrate as the solution to be treated, the same being introduced into the first loop. The solution may further contain nitric acid. A solution of ammonium nitrate is used as the catholyte. When the solution has entered the anode compartment of the second cycle a ceriammoniacal nitrate solution is obtained.

Another application of the method and apparatus of the invention is in the preparation of ceric sulfate.

It is known that ceric sulfate solutions can be prepared by sulfuric action on precipitated ceric hydrate following oxidation with hydrogen peroxide. The solutions obtained are generally at a low concentration.

In the method of the invention, the solution circulated in the loops is of cerous sulfate, or possibly of ceric sulfate permanently resaturated with Ce III if a high concentration is desired, and it contains a small amount of sulfuric acid.

In order to further illustrate the present invention and the advantages thereof, the following specific examples are given, it being understood that same are intended only as illustrative, and in nowise limitative.

EXAMPLE 1

This example illustrates the application of the invention to oxidation of cerous nitrate, for the preparation of ceric nitrate.

The electrolytic cell used had the following characteristics:

| | |
|---|---|
| Active surface area: | 2 $dm^2$ |
| Anodes: | Expanded, rolled titanium coated with galvanic platinum |
| Cathodes: | Expanded, rolled titanium coated with galvanic platinum |
| Membrane: | Cationic, NAFION 423 (Du Pont de Nemours) |
| Membrane bearing on cathode | |
| Distance between anode and membrane = 14 mm. | |

The general operating conditions are reported below:

First loop circuit:
Rate of recirculation: 2.5 $m^3/h$
Feed solution cerous nitrate, 1.29 Mol/h
Nitric acid, 1.7 Mol/h
Feed rate = 1.93 l/h
Current strength = 60 amps
Second loop circuit:
Rate of recirculation: 2.5 $m^3/h$
Feed solution } overflow from first stage
Feed rate }
Current strength = 6.5 amps Under these conditions and in a state of equilibrium, the following results were obtained at the outlet from the two anode compartments:

First compartment:
Temperature = 46° C.
Voltage = 3.78 volts
Rate of output: 1.88 l/h
Concentration
$Ce^{4+}$ = 1.13 Mol/l
$Ce^{3+}$ = 0.14 Mol/l
Conversion rate = 89.0%
Faraday yield = 94.9%

Second compartment:
Temperature = 44° C.
Voltage = 2.30 volts
Rate of output = 1.87 l/h
Concentration
$Ce^{4+}$ = 1.255 Mol/l
$Ce^{3+}$ = 0.018 Mol/l
Conversion rate = 98.6%
Total Faraday yield = 94.6%
Production of $CeO_2$ = 20.2 kg/h/$m^2$.

This first example illustrates obtaining extremely high conversion rates, compared with the values obtained in prior art processes relating to oxidation of cerium ($Ce^{4+}$/total amount of Ce=0.986), for an industrial current density (16.6 A/$dm^2$ over the entire electrolyzer) and perfectly satisfactory "Faraday yields" (FY=95%).

EXAMPLE 2

This example illustrates the same application as Example 1, but under different operating conditions.

The same cell was used, with the following modifications:

Anodes: Expanded titanium coated with galvanic platinum
Distance between anode and membrane reduced to 6 mm.

A turbulence promoter made of polypropylene with wide hexagonal meshes (trademark NETLON, Ref. 5000, produced by NORTENE) positioned between anode and diaphragm.

The operating conditions were also modified:

First loop circuit:
Rate of recirculation reduced to 0.65 $m^3/h$
Feed rate increased to 3.43 l/h
Current strength = 100 amps instead of 60
Second loop circuit:
Rate of recirculation: 0.65 $m^3/h$
Current strength = 16.4 amps In a state of equilibrium, the results at the outlet from the anode compartment were now as follows:

First compartment:
Temperature: 49° C.
Voltage: 4.25 volts
Rate of output: 3.32 l/h
Concentration:
$Ce^{4+}$ = 1.027 Mol/l
$Ce^{3+}$ = 0.212 Mol/l
Conversion rate = 82.9%
Faraday yield = 91.4%

Second compartment:
Temperature = 46° C.
Voltage = 2.62 volts
Rate of output = 3.305 l/h
Concentration:
$Ce^{4+}$ = 1.202 Mol/l
$Ce^{3+}$ = 0.034 Mol/l
Conversion rate = 97.2%
Total Faraday yield = 91.5%
Production of $CeO_2$ = 34.2 kg/h/$m^2$ In this example the average current density was virtually 30 A/$dm^2$. Although it was very high for this type of oxidation, a satisfactory Faraday yield was still maintained: FY>90% and the conversion rate was still very high: $Ce^{4+}$/total amount of Ce=0.972.

Under these conditions there was attained very high productivity per unit of active surface area of electrode (34 kg/h/$m^2$) with a very low residual content of cerous ions, thus providing very low costs of oxidation.

EXAMPLE 3

This example illustrates the application of the invention to the preparation of ceric sulfate.

The entire cell from Example 2 was used again and charged with an acid solution of cerous sulfate:

Cerous sulfate=0.273 Mol/l
Sulfuric acid=0.725 Mol/l.

Operating conditions:
First loop circuit:
Rate of recirculation: 2.5 $m^3/h$
Feed rate: 5.40 l/h
Current strength = 33.2 amps -continued

| Operating conditions: |
|---|
| Second loop circuit: |
| Rate of recirculation: 2.5 $m^3/h$ |
| Feed rate: overflow from first stage |
| Current strength: 5.6 amps |

| Results obtained: |
|---|
| First anode compartment: |
| Temperature: 43° C. |
| Voltage: 2.61 volts |
| Rate of output: 5.36 l/h |
| Concentration: |
| $Ce^{4+}$ = 0.227 Mol/l |
| $Ce^{3+}$ = 0.044 Mol/l |
| Conversion rate = 83.8% |
| Faraday yield = 98.2% |
| Second anode compartment: |
| Temperature: 41° C. |
| Voltage: 1.95 volts |
| Rate of output: 5.35 l/h |
| Concentration: |
| $Ce^{4+}$ = 0.264 Mol/l |
| $Ce^{3+}$ = 0.006 Mol/l |
| Conversion rate = 97.8% |
| Faraday yield = 97.6% |
| Production $Ce^{4+}$ = 70.6 Mol/h/$m^2$ |

EXAMPLE 4

The cell was supplied as in the previous example. The first compartment was operated at a current density of 28 A/$dm^2$.

The conversion rate was 80% and the Faraday yield was 96%.

Cerous sulfate was dissolved in the solutions leaving the first compartment, such that the solution was reconcentrated before entering the second compartment of the electrolyzer.

Cerium concentration entering second compartment after enrichment:

Ceric sulfate=0.217 Mol/l

Cerous sulfate=0.260 Mol/l.

| Operating conditions in second compartment: |
|---|
| Flow rate = 9.6 l/h |
| Current strength = 52 amps |
| Rate of recirculation = 2.5 $m^3/h$ |

| Results at outlet of electrolyzer: |
|---|
| Flow rate = 9.55 l/h |
| Concentration: |
| $Ce^{3+}$ = 0.064 Mol/l |
| $Ce^{4+}$ = 0.413 Mol/l |
| Conversion rate = 86.6% |
| Total Faraday yield = 97% |
| Production $Ce^{4+}$ = 197 Mol/h/$m^2$ |

Obtaining a very high conversion rate without sacrificing Faraday yield, and providing a solution with a relatively high concentration of ceric sulfate, via resaturating it between the two compartments, are thus again demonstrated for the case of cerous sulfate, with an average current density of 27 A/$dm^2$.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. Apparatus for oxidizing an ionic compound, which comprises an electrolytic cell comprising first and second anode compartments and a cathode compartment, and a pair of cationic membranes respectively separating said cathode compartment from said first and second anode compartments; means for transferring a portion of anolyte from said first to said second anode compartment; and means for recycling a portion of first anode compartment anolyte.

2. The apparatus as defined by claim 1, further comprising means for recycling a portion of second anode compartment anolyte and means for separate recovery of second anode compartment anolyte.

3. The apparatus as defined by claim 2, further comprising means for recycling a portion of cathode compartment catholyte.

4. The apparatus as defined by claim 3, further comprising means for transferring a portion of cathode compartment catholyte to said first anode compartment recycle.

5. The apparatus as defined by claim 4, said means for transferring a portion of catholyte to said first anode compartment recycle comprising a bypass conduit.

6. The apparatus as defined by claim 1, said means for transferring a portion of anolyte from said first to said second anode compartment comprising a bypass conduit.

* * * * *